United States Patent [19]

Lanuzzi et al.

[11] Patent Number: 4,765,679

[45] Date of Patent: Aug. 23, 1988

[54] CHAIR HAVING A SEAT WITH FRONT AND REAR SEAT PORTIONS BEING HINGED TO EACH OTHER

[75] Inventors: Max Lanuzzi, Ponte Capriasca; Fredi Dubach, Baretswil, both of Switzerland

[73] Assignee: Drabert Sohne GmbH & Co., Minden, Fed. Rep. of Germany

[21] Appl. No.: 52,626

[22] Filed: May 20, 1987

[30] Foreign Application Priority Data

May 26, 1986 [DE] Fed. Rep. of Germany ..... 3617623

[51] Int. Cl.[4] ..... A47C 1/02

[52] U.S. Cl. ..... 297/316; 297/91; 297/300; 297/312

[58] Field of Search ..... 297/68, 83, 84, 86, 297/90, 91, 312, 316, 355, 285, 300, 321, 316

[56] References Cited

U.S. PATENT DOCUMENTS

| | | | |
|---|---|---|---|
| 3,869,172 | 3/1975 | James et al. | 297/316 |
| 4,471,994 | 9/1984 | Zund et al. | 297/316 |
| 4,521,053 | 1/1985 | De Boer | 297/316 |
| 4,533,177 | 8/1985 | Latone | 297/285 X |
| 4,682,814 | 7/1987 | Hansen | 297/316 X |
| 4,684,173 | 8/1987 | Locher | 297/300 |

*Primary Examiner*—James T. McCall

[57] ABSTRACT

A chair has a seat connected to the seat support (1) by means of a front guide rod (11). The seat includes front and rear seat portion (8) hinged to each other. The rear seat portion (8) is secured to the seat support (1) by means of a rigidly connected downwardly extending element to which one end of a second guide rod (16) is hinged by a bearing (17). The other end of the second guide rod is connected by another bearing (15) to a section (14) of the back rest support (3). The back rest support is hinged at the seat support (1). A force storage member (13) is connected by joints to both the seat support (1) and to the seat.

7 Claims, 1 Drawing Sheet

CHAIR HAVING A SEAT WITH FRONT AND REAR SEAT PORTIONS BEING HINGED TO EACH OTHER

BACKGROUND OF THE INVENTION

The present invention relates to a chair having a seat support mounted to a seat by means of a guide rod. The seat includes a front seat part to which a rear seat part is hinged, and through which a back rest support is hinged to the seat support.

In known chairs of this type it is disadvantageous that the back rest support unintentionally recedes at a soft setting when the seat is occupied. Another disadvantage of the prior art chairs is that the clearance between the back rest support or the back rest and the rear edge of the seat increases when the back rest is shifted to the rear.

SUMMARY OF THE INVENTION

It is a purpose of the present invention to provide for a chair of the above type which is designed in such a way that essentially same clearance is maintained from the rear edge of the rear seat portion when the back rest is shifted.

The solution to this problem, in accordance with the present invention, is achieved by the fact that the front seat part is secured to the seat support by means of a front guide rod and the rear seat portion is secured by means of a rigidly connected element which points backwardly and to which one end of the guide rod is secured by means of a bearing. The other end of the guide rod is connected to a section of the back rest support by means of another bearing, whereby a force storage member is pivot-connected both to the seat support and also to the seat.

The seat of the present invention assures that the clearance of the seat remains practically the same from the back rest across the entire range of its movement.

A preferred embodiment of the invention is described in detail below with reference being made to the drawings in which:

DESCRIPTION OF THE PREFERRED EMBODIMENT

Figure 1:
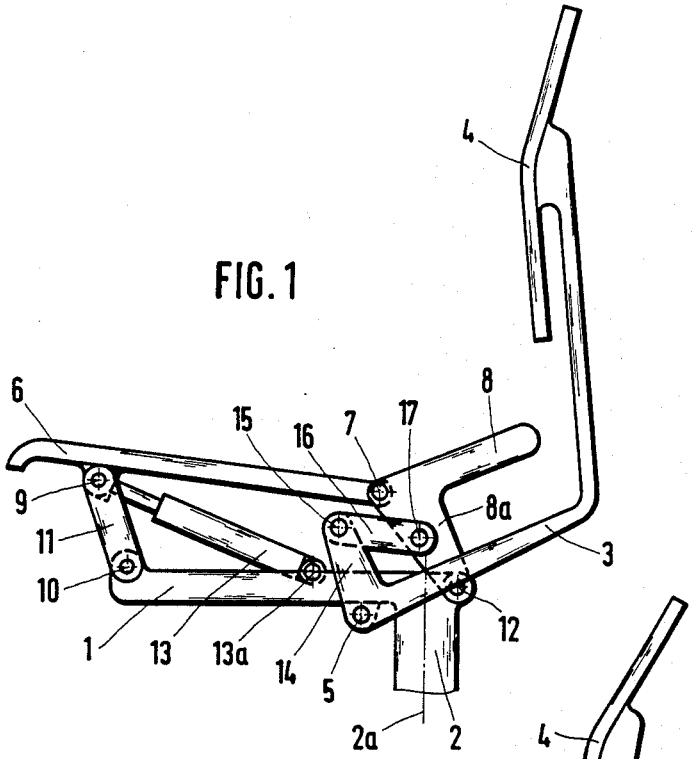
FIG. 1 shows a schematic lateral view of the upper portion of a seat with the back rest in a forward position.
Figure 2:
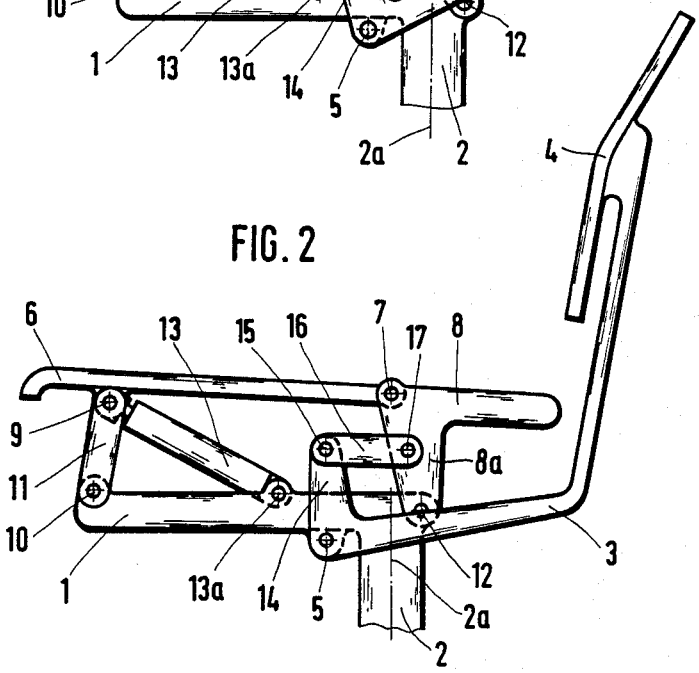
FIG. 2 shows a seat in accordance with FIG. 1 with the back rest in a position sloped backward.

As shown in FIGS. 1 and 2 a back rest support 3 is mounted onto a seat support 1, which is rigidly connected to the lower portion of the chair 2, with the back rest 4 hinged in the rotational bearing 5. In the embodiment shown, the lower portion of the chair 2 is designed as a chair stem.

The chair seat includes a front seat portion 6 and a rear seat portion 8 connected to it so that it can pivot by means of a joint at its back end.

The front portion of the seat 6 is connected to a guide rod 11 by means of a bearing 9. The guide rod 11 is connected to the seat support 1 by means of a bearing 10. One end of a force storage member 13 engages at the bearing 9. The force storage member is connected at the other end to the seat support 1 by means of a bearing 13*a*.

The rear portion of the seat 8 is designed in its basic form as an angled lever and has an element 8*a* which is hinged to the seat support 1 and to the upper portion of the lower frame of the chair 2 by means of a bearing 12. A bearing 17 is provided between the joint 7 and the bearing 12 to which another guide rod 16 is hinged. The guide rode 16 is connected to an area 14 of the back rest support 3 which juts upwardly by means of a bearing 15.

The back rest support 3 is designed as an angled lever near the bearing 6.

When the back rest 4 is moved out of the position shown in FIG. 1 to a position which is sloped backward, the rear portion of the seat 8 lowers.

By arresting the force storage member 13, which is a gas-filled spring in the embodiment depicted here, the back rest and the seat which is moved simultaneously with it, can be arrested in any desired moving position.

We claim:

1. A chair comprising:

a seat having a front seat portion (6) and a rear seat portion (8) hinged to each other;

a seat support (1) connected to said front seat portion (6) by means of a first guide rod (11) and to said rear seat portion (8) by means of a downwardly extending element (8*a*), rigidly connected to said rear seat portion (8);

a back rest support (3) having a back rest connected to one end, and a connecting section (14) at the opposite end, whereby said back rest support (3) is hinged to said seat support (1);

a second guide rod (16) having one end secured by a first bearing (17) to said element (8*a*) and an opposite end connected to said section (14) by a second bearing (15); and a force storage member (13) connected by hinges at one end to said seat support (1) and at another end to said first guide rod (11) of said seat (6,7,8).

2. A chair comprising:

a seat having a front seat portion (6) and a rear seat portion (8) hinged to each other;

a seat support (1) connected to said front seat portion (6) by means of a first guide rod (11) and to said rear seat portion (8) by means of a downwardly extending element (8*a*) being rigidly connected to said rear seat portion (8);

a back rest support (3) having a back rest (4) connected to one end, and a connecting section (14) at the opposite end, whereby said back rest support (3) is hinged to said seat support (1);

a second guide rod (16) having one end secured by a first bearing (17) to said element (8*a*) and an opposite end connected to said connecting section (14) by a second bearing (15);

a force storage member (13) connected by hinges (13*a* and 9) at one end to said seat support (1) and at another end to said seat (6,7,8);

the first guide rod (11) being connected by hinges (9 and 10) at one end to said front seat portion (6) and at another end to said seat support (1); and said rigidly connected element (8*a*) connected by a hinge (12) to said seat support (1) or the upper part of a central stem (2) of the chair.

3. A chair according to claim 1 wherein said force storage member (13) is a gas-filled spring.

4. A chair according to claim 3 wherein said force storage member (13) is hinged to a third upper bearing (9) of said front guide rod (11).

5. A chair according to claim 4 wherein a fourth bearing (12) of the element (8*a*) of the rear portion of the seat (8) is located behind the central axis (2*a*) of the lower portion of the chair formed by a central stem (2), and a fifth bearing (5) of the back rest support (3) is located at the seat support (1) in front of the central axis (2*a*).

6. A chair according to claim 5 wherein said back rest support (3) is formed as an angled lever near said fifth bearing (5).

7. A chair according to claim 6 wherein said rear seat portion (8) is formed as an angled lever including said rigidly connected element (8*a*).

* * * * *